US005816936A

United States Patent [19]

Aizawa et al.

[11] Patent Number: 5,816,936

[45] Date of Patent: Oct. 6, 1998

[54] GOLF CLUB HEAD AND METHOD OF MANUFACTURING THE SAME

[75] Inventors: Yuichi Aizawa; Mahito Kimura; Yasuto Imai, all of Tokyo, Japan

[73] Assignee: Daiwa Seiko, Inc., Tokyo, Japan

[21] Appl. No.: 376,409

[22] Filed: Jan. 23, 1995

[30] Foreign Application Priority Data

Jan. 24, 1994 [JP] Japan ..... 6-005812

[51] Int. Cl.[6] ..... A63B 53/04

[52] U.S. Cl. ..... 473/342; 473/335; 473/350

[58] Field of Search ..... 273/173, 167 R, 273/167 F, 77 A, 164, 169, 171; 473/350, 342, 329, 330, 331, 335, 348, 349

[56] References Cited

U.S. PATENT DOCUMENTS

| | | | |
|---|---|---|---|
| 3,814,437 | 6/1974 | Winquist | 273/167 R |
| 3,863,932 | 2/1975 | Lezatte | 273/173 |
| 4,809,978 | 3/1989 | Yamaguchi et al. | 473/329 |
| 4,811,950 | 3/1989 | Kobayashi | 473/335 |
| 4,884,812 | 12/1989 | Nagasaki et al. | 473/342 |
| 5,176,384 | 1/1993 | Sata et al. | 273/167 R |
| 5,403,007 | 4/1995 | Chen | 473/342 |
| 5,547,194 | 8/1996 | Aizawa et al. | 473/342 |

FOREIGN PATENT DOCUMENTS

| | | | |
|---|---|---|---|
| 3-19398 | 4/1991 | Japan | 473/342 |
| 5-61951 | 9/1993 | Japan | 423/342 |

*Primary Examiner*—Aaron J. Lewis
*Assistant Examiner*—Charles W. Anderson
*Attorney, Agent, or Firm*—Longacre & White

[57] ABSTRACT

The invention relates a golf club head with a structure which can stabilize the direction of the hit ball and can enhance a ball hitting feeling. In the golf club head, a recessed portion is formed in a face portion of a head main body formed of metal with the peripheral edge portion of the face portion remaining unrecessed. A face plate formed of material smaller in specific gravity than the head main body is mounted to the recessed portion. A frame member formed of material larger in specific gravity than the head main body and softer than the face plate and head main body is held by and between the peripheral wall of the face plate and the peripheral wall of the recessed portion.

19 Claims, 5 Drawing Sheets

GOLF CLUB HEAD AND METHOD OF MANUFACTURING THE SAME

BACKGROUND OF THE INVENTION

The present invention relates to a golf club head which improved to stabilize the direction of the hit ball and enhance the ball hitting feeling, and a method of manufacturing the same.

It is generally known that, if a face plate having specific gravity lower than a head main body of an iron club head is mounted on a face portion of the head main body to make heavier a peripheral edge portion of the head main body, then the moment of inertia of the head main body can be increased and thus the direction of the hit ball can be stabilized.

In view of the above fact, there is known an iron club head (see Japanese Utility Model Publication No. 5-61951 of Heisei) in which, as shown in FIGS. 9 and 10, a through hole 5 and a recessed portion 7 are formed in a face portion 3 of a head main body 1 formed of metal with the peripheral edge portion of the face portion 3 remaining unrecessed, and a face plate 9 having specific gravity lower than the head main body 1 is mounted on the recessed portion 7 to thereby form a cavity (a recess-like portion) 13 in a back portion 11 of the head main body 1.

According to the above disclosed iron club head, since the cavity 13 is formed in the back portion 11 with the peripheral edge portion thereof remaining unrecessed and the ball hitting surface is formed by the face plate 9 having small specific gravity, the weight of the head main body 1 is dispersed to the peripheral edge portion of the head main body 1 and thus the moment of inertia of the head main body 1 is increased when swinging an iron club with such head, thereby being able to stabilize the direction of the hit ball.

On the other hand, in Japanese Utility Model No. 3-19398 of Heisei, there is disclosed an iron club head in which, as shown in FIGS. 11 and 12, a cavity 19 is formed in a back portion 17 of a head main body 15 with the peripheral edge portion 17*a* of the back portion 17 remaining unrecessed and also a ring-shaped metal plate 23 is attached into an annular recess 21 so formed as to extend along the outer periphery of the peripheral edge portion 17*a*, thereby being able to enhance further the moment of inertia of the head main body 17.

However, in the iron club heads of these types, the head main body thereof is formed of metal such as soft iron, stainless steel or the like, that is, the hosel portion, sole portion, face portion and other portions of the head main body are formed of metal integrally with one another to thereby form a mass of metal, so that it can provide only a hard ball hitting feeling. Although there has been developed a golf club head, like the golf club head described in connection with FIG. 9, that the ball hitting feeling is enhanced by mounting the face plate 9 on the face portion 3 of the head main body 1, it is still impossible to obtain such a soft ball hitting as a wooden club can.

SUMMARY OF THE INVENTION

The present invention aims at eliminating the drawback found in the conventional golf club head. Accordingly, it is an object of the invention to provide a golf club head with an improved arrangement which can stabilize the direction of the hit ball and also can enhance the ball hitting feeling, and a method of manufacturing the same. Another object of the invention is to provide a golf club head and a method of manufacturing the same in which a face plate can be fixed to a face portion of a head main body securely with ease.

In order to attain the above-noted and other objects, a golf club head of a preferred embodiment of the invention is constructed such that a recessed portion is formed in a face portion of a head main body formed of metal with the peripheral edge portion of the face portion remaining unrecessed, a face plate having smaller specific gravity than the head main body is mounted on the recessed portion, a frame member having larger specific gravity than the head main body and formed of material softer than the face plate and head main body is held by and between the peripheral wall of the face plate and the peripheral wall of the recessed portion. A groove is formed in the peripheral edge portion of a back portion of a head main body formed of metal and a frame member formed of material having greater specific gravity than the head main body is mounted on the groove.

The present invention further provides a preferable method of manufacturing such golf club head, in which a recessed portion is formed in a face portion of a head main body formed of metal with the peripheral edge portion of the face portion remaining unrecessed, a face plate formed of material having smaller specific gravity than a head main body and a frame member formed of material softer than the face plate and head main body are disposed in the recessed portion in such a manner that the frame member is situated in the outer periphery of the face plate, and the face plate and frame member are depressed and deformed by dies to thereby mount the face plate and frame member to the recessed portion.

In the golf club head manufacturing method, the recessed portion to be formed in the face portion of the head main body is made up of a face plate mounting recessed portion and a frame member mounting recessed portion formed shallower than the face plate mounting recessed portion, the peripheral walls of the two mounting recessed portions are respectively formed in a dovetail surface, a face plate and a frame member are disposed in their respective mounting recessed portions such that the frame member is situated in the outer periphery of the face plate, and, after then, the face plate and frame member is depressed by use of dies so that they are deformed along the respective peripheral walls of the mounting recessed portions, thereby mounting the face plate and frame member to the recessed portions.

It is also applicable in the golf club head manufacturing method that the peripheral wall of the recessed portion to be formed in the face portion of the head main body is formed in a dovetail surface, the inner peripheral wall of the frame member to be in contact with the peripheral wall of the face plate is inclined in the outer peripheral wall direction of the frame member from the front side of the frame member toward the rear side thereof, the peripheral wall of the face plate is inclined such that it coincides with the inner peripheral wall of the frame member, the face plate and frame member is situated in the outer periphery of the face plate, and, after than, the face plate and frame member are depressed by use of dies so that the frame member is deformed along the peripheral wall of the recessed portion, thereby mounting the face plate and frame member onto the recessed portion.

If a golf player swings a golf club incorporating the golf club head according to the present invention, then the head main body can draw an intended, accurate locus due to the moment of inertia thereof when hitting the ball because the frame member having large specific gravity mounted to the face portion increases the moment of inertia of the head main body.

Since the frame member held by and between the peripheral wall of the face plate and the peripheral wall of the recessed portion is formed of material softer than the head main body and face plate, the frame member softens the hard ball hitting feeling of the face plate when hitting the ball so that the golf player can be given a soft ball hitting feeling.

Further, by use of the frame member the face plate can be positively fixed to the face portion of the golf club head with an easier manner.

In addition, the combination of the frame member on the face portion with the frame member mounted to the back portion enhances further the moment of inertia of the head main body.

According to the golf club head manufacturing method of the invention, the frame member is disposed in the recessed portion formed in the face portion of the head main body in such a manner that the frame member is situated in the outer periphery of the face plate, and the face plate and frame member is contracted and deformed by dies, whereby the face plate and frame member can be mounted to the recessed portion at the same time.

DETAILED DESCRIPTION OF THE PREFERRED EMBODIMENTS

Figure 1:
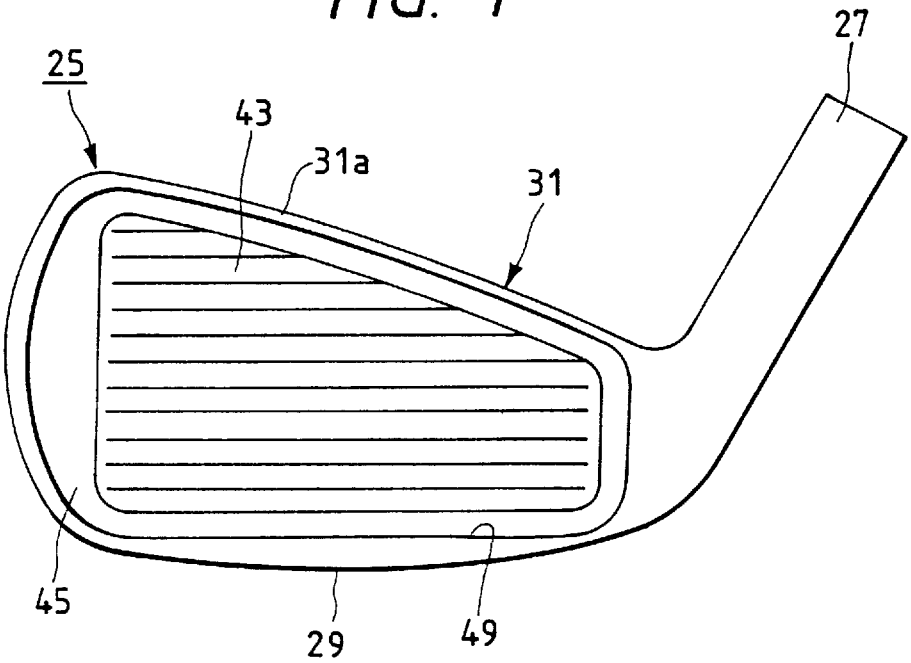
FIG. 1 is a front view of a golf club head according to an embodiment of the invention.

Now, description will be given below in detail of the embodiments of the invention with reference to the accompanying drawings.

FIGS. 1 to 5 respectively show a golf club head according to an embodiment of the invention, and in these figures, reference character 25 designates a head main body of an iron club formed of stainless steel. The head main body 25, similarly to the conventional ones, includes a hosel portion 27, a sole portion 29, face portion 31 and the like which are formed integrally with one another.

Figure 2:
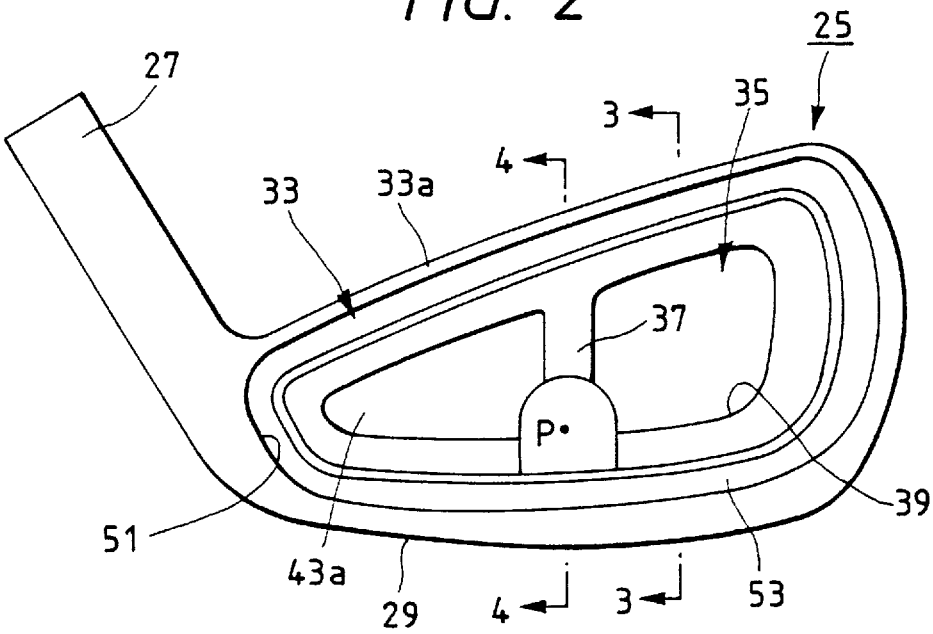
FIG. 2 is a back view of the golf club head shown in FIG. 1.
Figure 3:
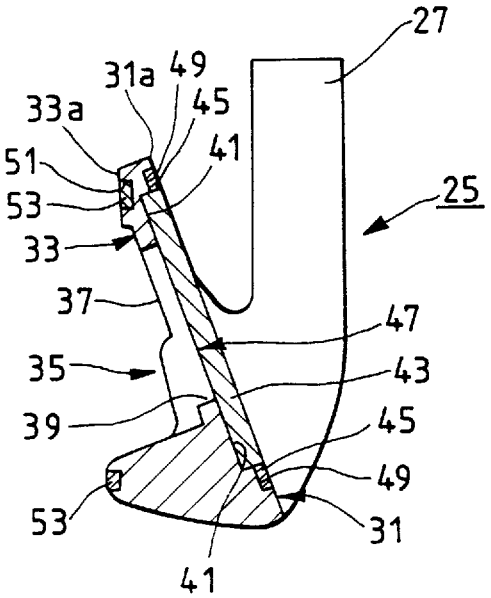
FIG. 3 is a section view taken along the line 3—3 in FIG. 2
Figure 4:
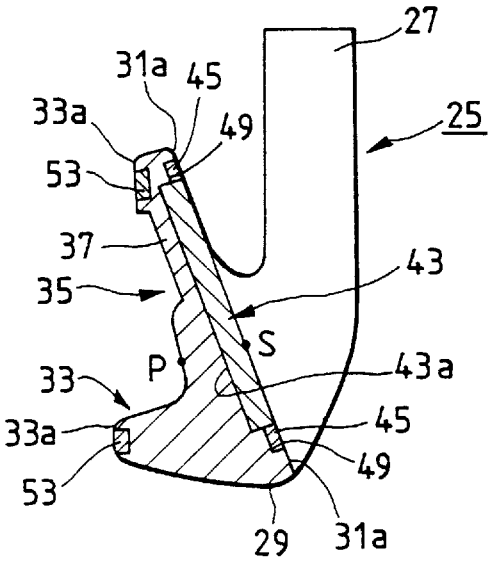
FIG. 4 is a section view taken along the line 4—4 in FIG. 2.

As shown in FIGS. 2 to 4, in the back portion 33 of the head main body 25, there is formed a recess-like cavity 35 with the peripheral edge portion 33*a* of the back portion 33 left unrecessed and, in the cavity 35, a rib-shaped support portion 37 having a thickness smaller than the peripheral edge portion 33*a* is provided integrally with the head main body 25 in such a manner that it extends from the top side of the peripheral edge portion 33*a* to the sole side thereof and passes through a sweet spot corresponding position P (a position in which a perpendicular line drawn from the sweet spot S of the ball hitting surface toward the back portion 33 of the head main body 25 intersects the back portion 33).

As shown in FIG. 3, a through hole 39 is formed to extend from the back portion 33 to the face portion 31. The face portion 31 has a face plate mounting recessed portion 41 provided around the through hole 39 with the peripheral edge portion 31*a* remaining untreated. A thin face plate 43 formed of titanium alloy is mounted to the face plate mounting recessed portion 41. Thus, the cavity 35 is formed in such a manner that the through hole 39 is closed by the face plate 43 fitted into the face plate mounting recessed portion 41. As shown in FIG. 4, the back side (namely, rear surface) 43*a* of the face plate 43 is in contact with and is supported by the support portion 37.

As shown in FIGS. 2 and 4, the support portion 37 is formed such that a portion in the vicinity of the sweet spot corresponding position P has a larger thickness than the remaining portions thereof. In other words, by increasing the thickness of that portion of the support portion 37 in the vicinity of the sweet spot corresponding position P portion in this manner, the surface rigidity of the sweet spot S can be increased further.

As described above, while the face plate 43 is mounted to the face portion 31 of the head main body 25 as shown in FIG. 1, there is further mounted between the outer periphery of the face plate 43 and the head main body 25 a ring-shaped frame member 45 formed of beryllium-copper alloy which is larger in specific gravity than the head main body 25 and softer than the face plate 43 and head main body 25.

In other words, in the face portion 31 of the head main body 25, as shown in FIG. 3, there is formed a recessed portion 47 with the peripheral edge portion 31a thereof left unrecessed, and the recessed portion 47 includes the above-mentioned face plate mounting recessed portion 41 and a frame member mounting recessed portion 49 which is formed in the periphery of the recessed portion 41 and is shallower in depth than the recessed portion 41. The through hole 39 is opened up in the face plate mounting recessed portion 41.

Figure 5:
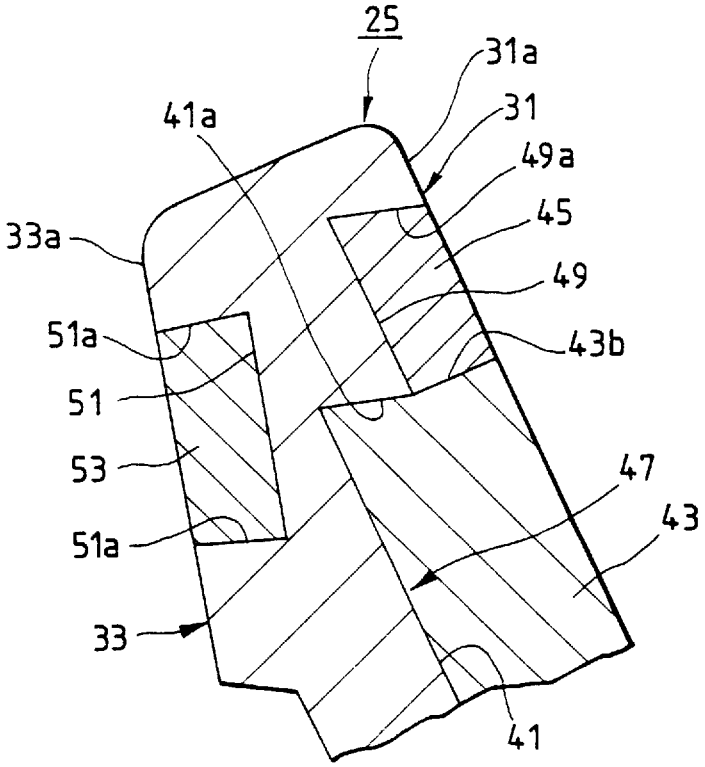
FIG. 5 is an enlarged section view of the main portions of the golf club head shown in FIG. 1.

As best shown in FIG. 5, the respective inner walls 41*a* and 49*a* of the face plate mounting recessed portion 41 and frame member mounting recessed portion 49 are formed in dovetail or under-cut surfaces, while the face plate 43 and frame member 45 are respectively so formed as to extend along the inner walls 41*a* and 49*a*. The frame member 45 is held by and between the peripheral wall 43*b* of the face plate 43 and the peripheral wall 49*a* of the frame mounting recessed portion 49 to thereby prevent the face plate 43 and frame member 45 from be removed from the recessed portion 47.

Further, as shown in FIGS. 2 to 5, in the peripheral edge portion 33*a* of the back portion 33 of the head main body 25, there is formed an annular groove 51 having a peripheral wall 51*a* which is formed in a dovetail or under-cut surface, and a ring-shaped frame member 53 is pressed into and mounted to the groove 51. The frame member 53 is formed of the same material as the above-mentioned frame member 45.

The above-mentioned iron head club according to the present embodiment can be manufactured with the following iron head club manufacturing method.

At first, after the frame member 53 is disposed in the groove 51 (this state is not shown), the frame member 53 is depressed by use of dies and is thereby deformed along the peripheral wall 51*a* of the groove 51, so that the frame member 53 is mounted into the groove 51 securely.

Figure 6:
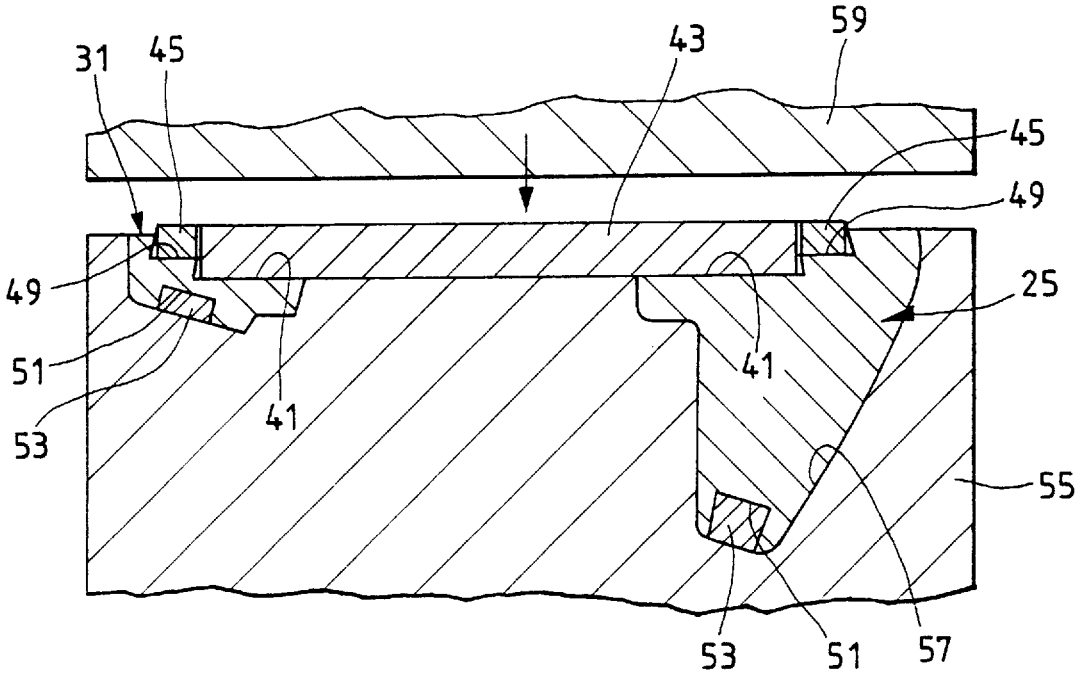
FIG. 6 is a section view of dies and a head main body, showing a process of manufacturing the golf club head shown in FIG. 1.
Figure 7:
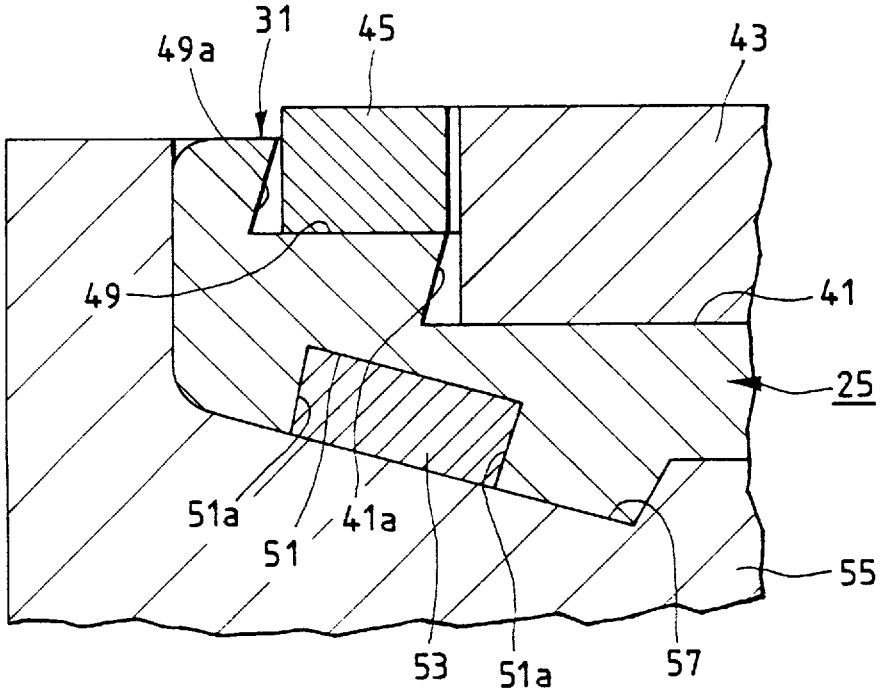
FIG. 7 is a section view of the main portions of the dies and head main body shown in FIG. 6.

Next, as shown in FIG. 6, the head main body 25 with the frame member 53 thus mounted to the back portion 33 thereof is put into a cavity 57 formed in a lower die 55 with the face portion 31 thereof facing upwardly, and the face plate 43 and the frame member 45 are disposed in the respective mounting recessed portions 41 and 49. Here, as shown in FIG. 7, since the face plate 43 and frame member 45 are respectively so formed as to have thicknesses larger than the depths of the respective mounting recessed portions 41 and 49, when the face plate 43 and frame member 45 are disposed in their respective mounting recessed portions 41 and 49 in this manner, the respective surface portions of the face plate 43 and frame member 45 are projected out above the face portion 31.

In the above-mentioned method, the frame member 45 is fitted into the outer periphery of the face plate 43 and, after then, these components are disposed in their respective mounting recessed portions 41 and 49. However, this is not limitative but, alternatively, instead of this method, the face plate 43 and frame member 45 may be individually disposed in the face plate mounting recessed portion 41 and the frame mounting recessed portion 49.

After completion of the above-mentioned operation, the face plate 43 and frame member 45 are depressed by use of an upper die 59 as shown in FIG. 6 so that they are deformed along the peripheral walls 41*a* and 49*a* respectively, the head main body 25 is taken out from the cavity 57 and the face portion 31 and back portion 33 thereof are polished, thereby being able to manufacture the head main body 25 with the face plate 43 and frame member 45 mounted on the recessed portion 47 of the face portion 31, as shown in FIGS. 1 to 5.

Since the golf club head according to the present embodiment is structured in this manner, if a golf player swings a golf club incorporating the present golf club head, then the head main body 25 does not shift or vibrate but can draw an intended, accurate locus due to its movement of inertia when hitting the ball, because the frame members 45 and 53 each having large specific gravity and respectively mounted to the peripheral edge portions 31*a* and 33*a* of the face portion 31 and back portion 33 enhance the moment of inertia of the head main body 25.

Further, due to the fact that the frame member 45 held by and between the peripheral wall 43*b* of the face plate 43 and the peripheral wall 49*a* of the frame member mounting recessed portion 49 is formed of beryllium-copper alloy softer than the head main body 25 and face plate 43, the frame member 45 softens the hard ball hitting feeling of the face plate 43 when hitting the ball, so that the golf player can be given a pleasant soft ball hitting feeling.

Further, since the support portion 37 provided in the cavity 35 is formed thinner than the peripheral edge portion 33*a* and only a portion in the vicinity of the sweet spot corresponding position P is formed thick, and also since the frame members 45 and 53 each having large specific gravity are mounted to the two peripheral edge portions 31*a* and 33*a* as mentioned above, there is no possibility of impairing the concept that the weight of the head main body 25 is dispersed to the peripheral edge portion thereof to thereby increase the moment of inertia of the head main body 25. Moreover, the support portion 37 supports and reinforces the face plate 43 to thereby enhance the surface rigidity of the sweet spot S.

Therefore, according to the golf club head of the present embodiment, since the moment of the inertia of the head main body 25 is enhanced by the frame members 45 and 53 respectively mounted to the face portion 31 and back portion 33, when compared with the conventional ones, the direction of the ball hit by a golf club using the present head can be further stabilized and, at the same time, due to the increased surface rigidity of the sweet spot S, the carry of the hit ball can be extended.

Further, according to the present embodiment, because the frame member 45 mounted to the periphery of the face plate 43 softens the hard ball hitting feeling of the face plate 43, a softer ball hitting feeling can be obtained when compared with the conventional iron club.

According to the above-mentioned manufacturing method, since, when mounting the face plate 43 onto the recessed portion 47, the frame member 45 can be mounted to the head main body 25 simultaneously with the face plate 43, a golf club head having the above-mentioned effects can be manufactured very easily.

In addition, the provision of the rib-like support portion 37 contributes to preventing the deformation of the head main body during the manufacturing process.

Figure 8:
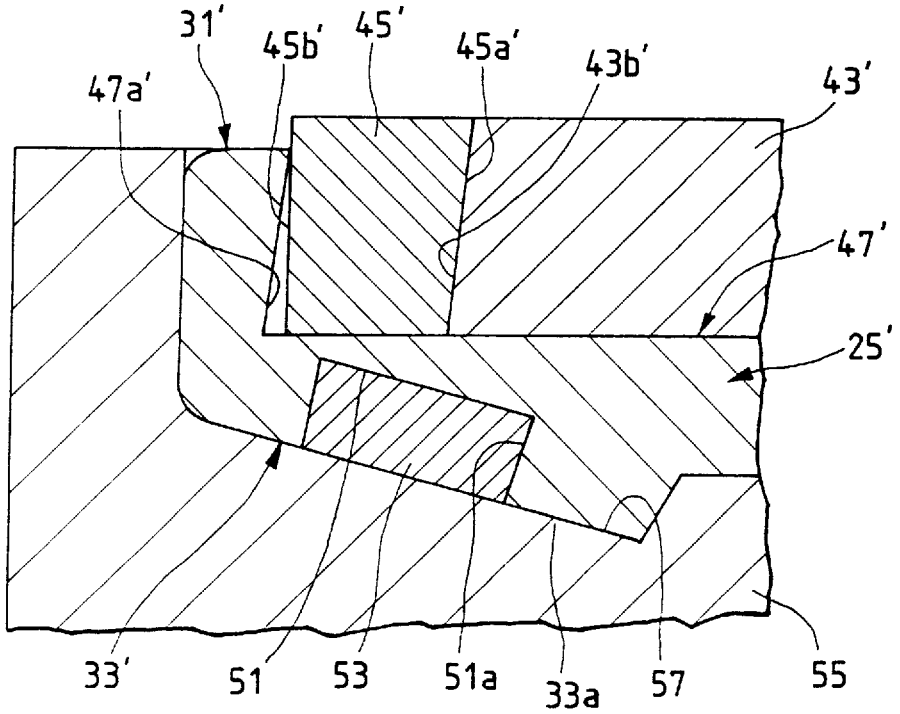
FIG. 8 is a section view of dies and a head main body, showing another process of manufacturing a golf club head according to the present invention.
Figure 9:
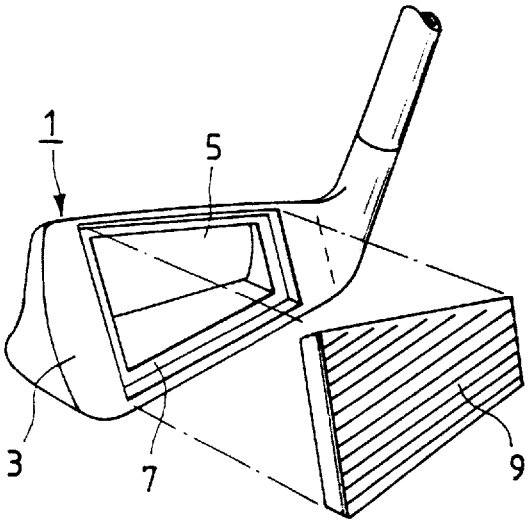
FIG. 9 is an exploded perspective view of a conventional golf club head.
Figure 10:
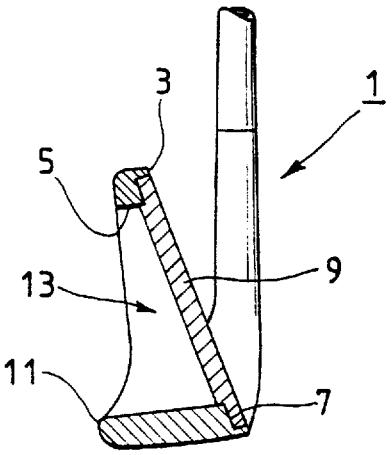
FIG. 10 is a section view of the golf club head shown in FIG. 9.
Figure 11:
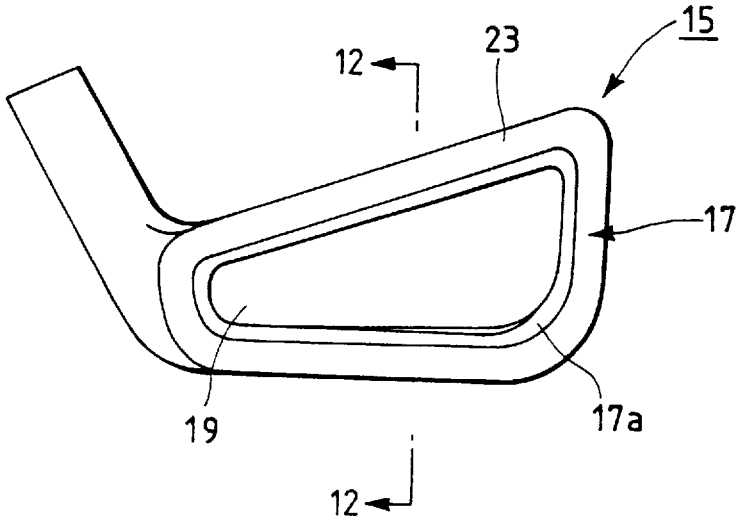
FIG. 11 is a back view of a conventional golf club head.
Figure 12:
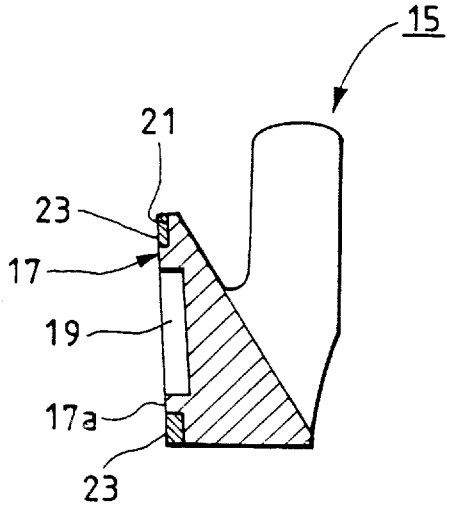
FIG. 12 is a section view of the golf club head shown in FIG. 11.

Now, FIG. 8 shows another method of manufacturing a golf club head according to the invention. As shown in FIG. 8, a face plate 43' and a frame member 45' are formed such that they have the same thickness. There is formed in a face portion 31' of a head main body 25' a recessed portion 47' into which the face plate 43' and frame member 45' can be mounted. The peripheral wall 47*a'* of the recessed portion 47' is formed in a dovetail or under-cut surface. The inner peripheral wall 45*a'* of the frame member 45' to be in contact with the peripheral wall 43*b'* of the face plate 43' is inclined toward the outer peripheral wall 45*b'* of the frame member 45' from the surface side of the frame member 45' to the rear surface side thereof. The peripheral wall 43*b'* of the face plate 43' is inclined so that it is coincident with the inner peripheral wall 45*a'* of the frame member 45'.

In the present embodiment as wall, similarly to the previously described embodiment of the manufacturing method, after the head main body 25' with the frame member 53 already mounted to the peripheral edge portion 33*a'* of the back portion 33' thereof is put in the cavity 57 of the lower die 55 with the face portion 31' facing upwardly, the face plate 43' and frame member 45' are placed in the recessed portion 47' in such a manner that the frame member 45' is situated in the outer periphery of the face plate 43', and the face plate 43' and frame member 45' are depressed by the upper die 59 to deform the frame member 45' along the peripheral wall 47*a'* of the recessed portion 47', thereby being able to mount the face plate 43' and frame member 45' simultaneously into the recessed portion 47' of the head main body 25'.

Accordingly, a golf club head manufactured according to the present embodiment, similarly to the golf club head according to the embodiment previously described in connection with FIGS. 1 to 5, is also able to accomplish the expected object of the invention. Also, by the manufacturing method according to the present embodiment as well, the above-mentioned golf club head can be manufactured quite easily.

As has been described before, in the embodiment shown in FIGS. 1 to 5, the through hole 39 is formed in the head main body 25 and the face plate 43 having specific gravity smaller than the head main body 25 is mounted on the face portion 31 of the head main body 25, thereby forming the cavity 35 in the back portion 33 of the head main body 25. However, the present invention is not limited to this structure but, of course, the present invention can also be applied to an iron golf club head in which no through hole is formed in a head main body but a face plate is mounted into a recessed portion formed in the face portion of the head main body.

Also, in the golf club head shown in FIGS. 1 to 5, the head main body 25 is formed of stainless steel, the face plate 43 is formed of titanium alloy, and the frame member 45 is formed of beryllium copper. However, this is not limitative but other combinations of material are also possible. For example, the head main body 25 may be formed of soft iron, the face plate 43 may be formed of aluminum-alloy, and the frame member 45 may be formed of copper. According to this structure as well, similarly to the above-mentioned embodiments, the expected object of the invention can be attained.

Further, in the respective embodiments, the frame member 53 is mounted into the groove 51 formed in the peripheral edge portions 33*a*, 33*a*' of the back portion 33, 33'. However, the frame member 53 may be omitted. Also, the frame member 53 is formed of the same material as the frame member 45 in the present embodiments. However, this is not limitative but the frame member 53 may also be formed of other different material, provided that the material is larger in specific gravity than the head main body 25, 25'.

Further the frame member 45 is provided to circumscribe the face plate 43 in the present embodiment. However, a pair of frame members may be provided at respective opposite two sides of the face plate 43.

As has been described heretofore, according to the golf club head, by the use of the frame member, the face plate can be fixed to the recess of the head main body securely with ease.

Further, since the moment of inertia of the head main body is enhanced by the frame member mounted to the face portion of the head main body, if a golf player swings a golf club using the present golf club head, then the direction of the hit ball can be further stabilized when compared with the conventional golf club head.

Furthermore, since the frame member softens the hard ball hitting feeling of the face plate when hitting the ball, a pleasant softer ball hitting feeling can be obtained in comparison to the conventional golf club head.

If another frame member is also mounted to the peripheral edge portion of the back portion of the head main body, the moment of inertia of the head main body is further enhanced to thereby be able to stabilize the direction of the hit ball still further.

If a different collar from those of the head main body and the face plate is applied to the frame member circumscribing the face plate, then the golfer can recognize the position of the face plate easily and clearly.

Further, according to the golf club head manufacturing method of the invention, due to the fact that, when mounting the face plate to the head main body, the frame member can be mounted into the recessed portion simultaneously with the face plate, a golf club head having the above-mentioned effect can be manufactured very easily.

What is claimed is:

1. A golf club head comprising:

a head main body formed of metal and having a face portion and a back portion opposite from said face portion;

a recessed portion formed in said face portion defined by a back wall and circumscribed by a periphery of said head main body;

a face plate formed of material smaller in specific gravity than said head main body and disposed within said recessed portion to be contiguous with said back wall; and a frame member depressingly inserted between an inner peripheral wall of said recessed portion and an outermost peripheral wall of said face plate so that said face plate together with said frame member is secured to said recessed portion.

2. A golf club head according to claim 1, wherein said frame member is formed of material larger in specific gravity than said head main body.

3. A golf club head according to claim 1, wherein said frame member is formed of material softer than said head main body and said face plate.

4. A golf club head according to claim 1, wherein said frame member is substantially in the form of a ring circumscribing said face plate.

5. A golf club head according to claim 1, wherein said frame member is flush with said face plate and said face portion of said head main body.

6. A golf club head according to claim 1, wherein said frame member is different in collar from said head main body and said face plate.

7. A golf club head according to claim 1, wherein said inner wall of said recessed portion define a dovetail surface.

8. A golf club head according to claim 1, wherein said recessed portion includes a deeper portion for receiving said face plate and a shallower portion disposed around said deeper portion for receiving said frame member.

9. A golf club head according to claim 1, further comprising:

a through hole passing through said head main body and extending from said recessed portion to said back portion, said through hole being closed by said face plate to define a cavity located in said back portion.

10. A golf club head according to claim 1, wherein said face plate is formed of material higher in modulus of elasticity than said head main body.

11. A golf club head according to claim 1, further comprising:

a groove formed in a periphery of said back portion; and another frame member made of material larger in specific gravity than said head main body and depressingly inserted into said groove.

12. A golf club head according to claim 1, wherein said face plate has a ball hitting surface and a rear surface opposite from said ball hitting surface and located nearer to said back side than said ball hitting surface, and said ball hitting surface is smaller in area than said rear surface.

13. A golf club head according to claim 9, wherein said through hole is divided by a support portion extending between mutually facing wall surfaces of said cavity, said face plate being kept in contact with said support portion.

14. A golf club head comprising:

a head main body formed of metal and having a face portion and a back portion opposite from said face portion;

a recess formed in said face portion defined by a back wall and an inner peripheral wall of said head main body;

a face plate formed of material smaller in specific gravity than said head main body and disposed within said recessed portion and adjacent to said back wall; and an annular frame member depressingly inserted between said inner peripheral wall of said recessed portion and an outermost peripheral wall of said face plate forming a wedge therebetween to secure said face plate together with said frame member to said head main body, said frame member extending into said recess no further than said face plate.

15. A golf club head according to claim 14 wherein said head main body is made of stainless steel and said frame member is made of berrylliun copper.

16. A golf club head according to claim 14 wherein said head main body is made of iron, said face plate is made of an aluminum alloy, and said frame member is made of copper.

17. A golf club according to claim 16, wherein said frame member extends into said head main body no further than said first back wall of said first recessed portion.

18. A golf club head comprising:

a head main body formed of metal and having a face portion and a back portion opposite from said face portion;

a first recess formed in said face portion defined by a first back wall and an inner peripheral wall of said head main body, said first recess including a second deeper recessed portion extending to a second back wall;

a face plate formed of material smaller in specific gravity than said head main body and disposed within said second deeper recessed portion adjacent to said second back wall; and an annular frame member depressingly inserted between said inner peripheral wall of said first recessed portion and an outer peripheral wall of said face plate so that said face plate together with said frame member is secured to said first recessed portion.

19. A golf club head according to claim 18, wherein said inner peripheral wall comprises first and second inner peripheral walls, said first recess is defined by said first back wall and said first inner peripheral wall, said second recess is defined by said second back wall and said second inner peripheral wall, wherein said first inner peripheral wall defines a dovetail surface to retain a portion of said face plate and said second inner peripheral wall defines a second dovetail surface to retain a portion of said annular frame member.

* * * * *